US007055803B2

(12) United States Patent
Suckow

(10) Patent No.: US 7,055,803 B2
(45) Date of Patent: Jun. 6, 2006

(54) CARPET STRETCHING APPARATUS

(76) Inventor: John G. Suckow, 1513 Lake Dr., Hubertus, WI (US) 53033

( * ) Notice: Subject to any disclaimer, the term of this patent is extended or adjusted under 35 U.S.C. 154(b) by 0 days.

(21) Appl. No.: 10/850,024

(22) Filed: May 21, 2004

(65) Prior Publication Data

US 2005/0258412 A1 Nov. 24, 2005

(51) Int. Cl.
*B25B 25/00* (2006.01)

(52) U.S. Cl. ..... 254/209; 254/200

(58) Field of Classification Search ..... 254/200, 254/201, 204, 207, 209, 212; 294/8.6
See application file for complete search history.

(56) References Cited

U.S. PATENT DOCUMENTS 1,033,552 A * 7/1912 Dehlinger ..... 254/204
3,572,800 A * 3/1971 Graziano ..... 294/8.6
4,577,837 A * 3/1986 Berg et al. ..... 254/212
4,934,658 A * 6/1990 Berg et al. ..... 254/212
5,129,696 A * 7/1992 Underwood ..... 294/8.6
5,472,170 A * 12/1995 Anasson ..... 254/212
5,607,141 A * 3/1997 Clark ..... 254/200
5,931,447 A * 8/1999 Butschbacher et al. ..... 254/200
5,938,182 A * 8/1999 Goodrich et al. ..... 254/209
6,161,818 A * 12/2000 Medwin ..... 254/200
6,669,173 B1 * 12/2003 Dunn ..... 254/201

* cited by examiner

*Primary Examiner*—Emmanuel M Marcelo
(74) *Attorney, Agent, or Firm*—John K. McCormick

(57) ABSTRACT

A carpet stretcher including a power stretcher head coupled to one end of an extension pole, a power stretcher tail piece coupled to one end of a second extension pole, one or more stretcher extensions intermediate said first and second extension poles and coupled to the ends thereof remote from said head and tail piece, and a stabilizer member longitudinally disposed relative to said poles and extensions and having a plurality of spring clamping members adapted to clip onto said poles and stretcher extensions to stabilize them from distortional bowing.

1 Claim, 1 Drawing Sheet

CARPET STRETCHING APPARATUS

BACKGROUND OF THE INVENTION

The present invention relates to carpet stretching apparatus and particularly to such apparatus for use in large rooms where the apparatus cannot reach opposing walls.

One of the problems with carpet stretching devices is that they are usually made from light weight metal such as hollow steel tubing or the like and thus when they are fully longitudinally extended to cover large carpeting areas they may bow out in either lateral direction or vertically.

SUMMARY OF THE INVENTION

It is, therefore, an object of the present invention to provide an elongated carpet stretching device having means disposed therein or thereon to prevent the device from bowing when extended and under longitudinal pressure.

It is another object of the present invention to provide in or on a device of the character above described, a section, also elongated and tubular, to prevent the stretcher from bowing upwardly or laterally when extended and under pressure.

It is still another object of the present invention to provide a device of the character above described extending and reinforcing structure having a plurality of spring clamping mechanisms, which may be added to the elongated stretcher by clamping thereon as desired.

Various other objects and advantages to the present invention may become apparent as this description proceeds, as will modifications and changes which can be made to the structure of the present invention without departing from the spirit thereof. It is intended that these objects, advantages, modifications and changes be covered by the scope of the appended claims.

BRIEF DESCRIPTION OF THE PREFERRED EMBODIMENT

Figure 1:
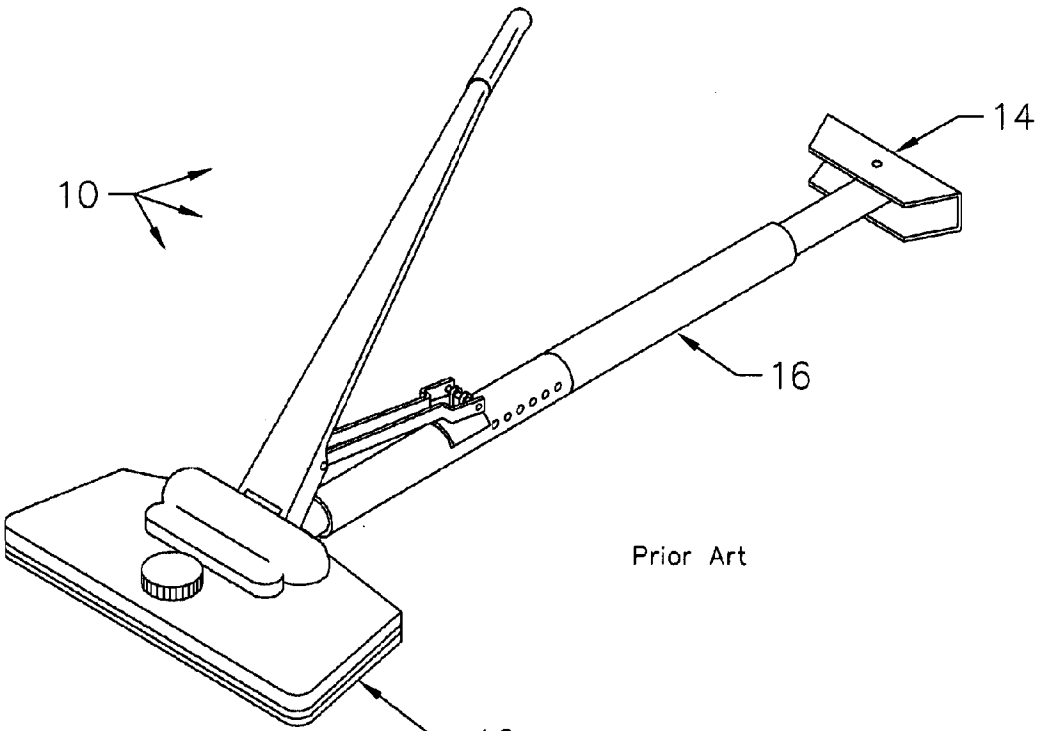
FIG. 1 is a horizontal plan view of a carpet stretcher of the existing art variety.
Figure 2:
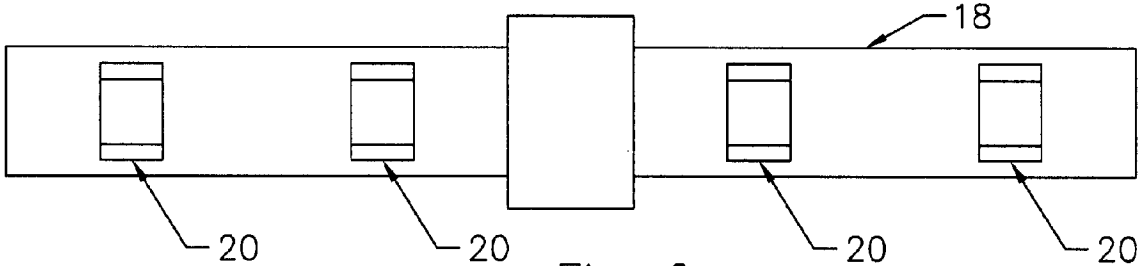
FIG. 2 is a horizontal plan view of an extender according to the present invention.
Figure 3:
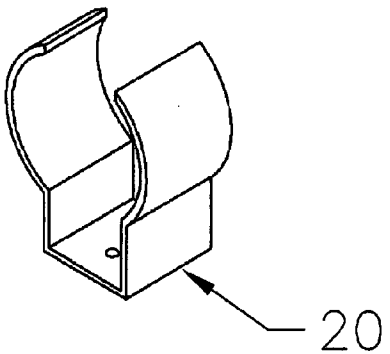
FIG. 3 is a perspective view of an expansion clip on the extender to show details of construction.

Referring now to the Drawings and more particularly to FIG. 1 thereof, a carpet stretching device is disclosed and generally identified by the numeral 10.

Carpet Stretcher 10 is provided with a stretcher head 12 and a tail piece 14 axially spaced from each other to form a longitudinally extended stretcher assembly along a common axis.

Extension poles 16 are coaxial with the stretcher 10 and are used to be a part of the stretcher 10 when it is being used in wall to wall stretching over a large expanse.

A stabilizer bar 18 is provided for use on the stretcher 10 when such large expanses are being carpeted that as pressure to stretch is exerted the poles 16 and stretcher assembly start to bow and fail to accomplish the stretching.

Stabilizer bar 18 actually is two coaxial pieces hingedly joined at one end of each and is provided with a plurality of expansion clips 20 affixed at desired locations along bar 18 by suitable fasteners such as screws or rivets (not shown). Clips 20 are spring clips and adapted to clip the stabilizer to the extension poles 16.

It can be easily seen that when bar 18 is aligned axially, the expansion clips 20 can be spring biased to engage with poles 16 to extend the entire stretcher 10. bar 18 is made from two pieces of heavy material which prevents poles 16 and bar 18 from distorting or bowing.

The invention claimed is:

1. A carpet stretcher including:

a) a power stretcher head, b) a power stretcher tail;

c) axially aligned power stretcher extension poles; and d) a power stretcher extension pole stabilizer member comprised of a solid flat rectangular bar with a plurality of spring clips fixedly attached to said flat bar, said stabilizer member adapted to be removably coupled in a longitudinally extending relationship to said extension poles by means of the plurality of spring clips for clamping to said extension poles to prevent the extension poles from bowing under stressing when stretching carpeting.

* * * * *